United States Patent [19]

Wagner

[11] Patent Number: 4,832,295

[45] Date of Patent: May 23, 1989

[54] STAND FOR SUPPORTING POTS AND PANS DURING COOKING

[76] Inventor: Hans R. Wagner, 25 Woodale La., Santa Barbara, Calif. 93103

[21] Appl. No.: 130,132

[22] Filed: Dec. 8, 1987

[51] Int. Cl.[4] ..... A47G 23/02

[52] U.S. Cl. ..... 248/152; 126/215; 248/346

[58] Field of Search ..... 248/152, 174, 346; 219/432, 443, 456; 126/215, 212, 214 A, 214 C, 218, 37 A, 39 H; D7/354; 432/232

[56] References Cited

U.S. PATENT DOCUMENTS

| | | | |
|---|---|---|---|
| 366,988 | 7/1887 | Wiester | 126/215 |
| 538,096 | 4/1895 | Boeck | 126/50 |
| 1,161,805 | 11/1915 | Slear | 126/215 |
| 1,509,630 | 9/1924 | Bates et al. | 126/215 |
| 1,786,562 | 12/1930 | Endorf | 126/215 |
| 2,285,698 | 6/1942 | Emmer | 126/215 |
| 3,871,356 | 3/1975 | Saponara | 126/215 |
| 4,245,808 | 1/1981 | John | 248/174 X |

FOREIGN PATENT DOCUMENTS

| | | | |
|---|---|---|---|
| 439440 | 6/1912 | France | 126/215 |

*Primary Examiner*—J. Franklin Foss

*Attorney, Agent, or Firm*—Milton S. Gerstein

[57] ABSTRACT

A fondue stand having four vertically upstanding partition walls defining upper edge surfaces upon which is supported a fondue pot. The vertical partition walls are angularly spaced apart on a main supporting frame such that, when the fondue pot is supported on the upper edge surfaces, the partition walls lie in vertical planes offset from, or at an angle to, the vertical planes containing the diameters of the circular cross section of the fondue pot. In an alternative embodiment, a security ring for a stove range is provided, with the main body portion being circular and having a central cutout from which extends a hollow central hub insertable into the circular opening of the range of the stove, for supporting pots and pans in a safe manner on the range.

13 Claims, 2 Drawing Sheets

STAND FOR SUPPORTING POTS AND PANS DURING COOKING

BACKGROUND OF THE INVENTION

The present invention is directed to a supporting stand for supporting pots and pans during cooking. The present invention has especial application for use in supporting a pot or chafing dish used in the type of cooking called Fondue, in which the burner for cooking the food is positioned beneath the chafing dish or pot with the chafing dish or pot resting upon a support ring beneath which stands the burner for cooking the contents in the chafing dish or pot. The support ring rests upon a table top, or the like, via a plurality of legs. However, such support for the chafing dish or pot does not readily protect against the tipping over of the chafing dish or pot, as could occur when children are seated at the table, or the like. Slight tipping of the support stand, or even the chafing dish, pot, or bowl theron, can lead to the falling out of the chafing dish, pot, or bowl from the stand, with concomitant spillage as well as hazard. Owing to the need for the spacing of the cooking pot from the table top, in order to prevent the unwanted heating up of the table top proper, the legs of the prior art fondue support stands are elongated, which increases the instability of the system, since the cooking pot is supported by the ring a relatively large distance above the table top, allowing for a magnification of torques or moments tending to topple the stand and system.

SUMMARY OF THE INVENTION

It is the primary objective of the present invention to provide a stand for supporting pots, pans, chafing dishes, and the like, in a much more stable manner as hitherto extant, in order to prevent the tippage over or collapse of the stand or cooking pot thereon.

It is another objective of the present invention to provide such a supporting stand that has especial use for supporting chafing dishes or pots used in the style of cooking called fondue.

It is another objective of the present invention to provide such a supporting stand that allows for the placement of a fondue burner centrally thereof.

It is yet another objective of the present invention to provide increased stability to the cooking pot/supporting stand combination such that it is quite difficult to accidentally tip it over, thereby preventing accidents and spillage.

It is another objective of the present invention to allow for such supporting stand to support any kind and type of cooking utensil in a more stable manner.

It is an objective of the present invention to allow for the use of a stand embodying therein the principles of the invention for use as a range-top safety ring for placement above the gas range of a stove, in order to increase the stability of the support of a cooking pot placed thereon during cooking.

According to the stand of the present invention, there are provided a plurality of relatively perpendicular, angularly spaced-apart vertical partitions, each partition having an upper edge surface upon which rests a portion of a pot, pan, chafing dish, and the like. The partitions, or support walls, are spaced such that two partitions diametrically opposed to another extend within parallel planes, which parallel planes are spaced apart, whereby a pair of two partitions are provided in vertical planes extending transversely to the vertical planes in which are provided the other two diametrically-opposed vertical supporting walls. Thus, each of the vertical walls, or partitions, is angularly offset from the diametric axes of a circular pot or pan resting on the upper edge surfaces of these walls, whereby two partitions or walls, one from one pair of parallel walls and the other from the other pair of parallel walls, are angularly closer to each other than the one partition of the one pair is to the remaining partition of the other pair, which enhances the stability of the supporting stand when a pot or pan is supported thereon, and more effectively prevents the tipping over of the pot or pan if the stand is accidentally tilted or struck.

BRIEF DESCRIPTION OF THE DRAWING

The invention will be more readily understood with reference to the accompanying drawings, wherein.

DETAILED DESCRIPTION OF THE INVENTION

Figure 1:
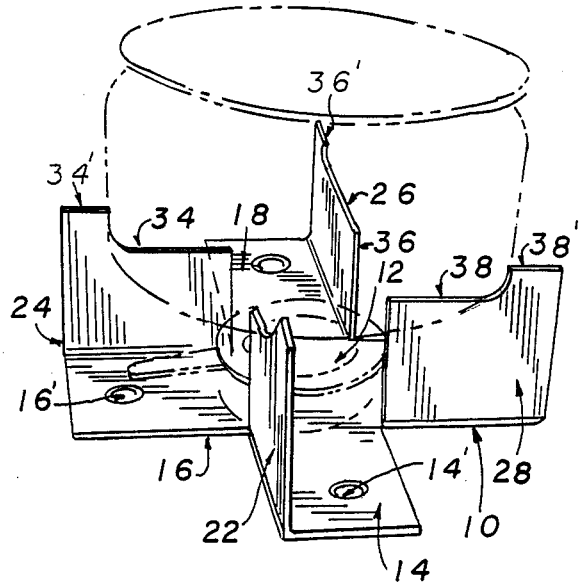
FIG. 1 is an isometric view of the supporting stand for pots, pans, chafing dishes and the like, of the present invention.
Figure 2:
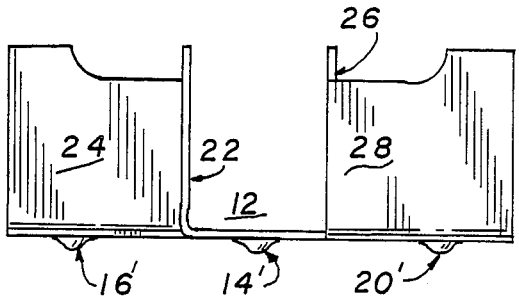
FIG. 2 is a side elevational view thereof.
Figure 3:
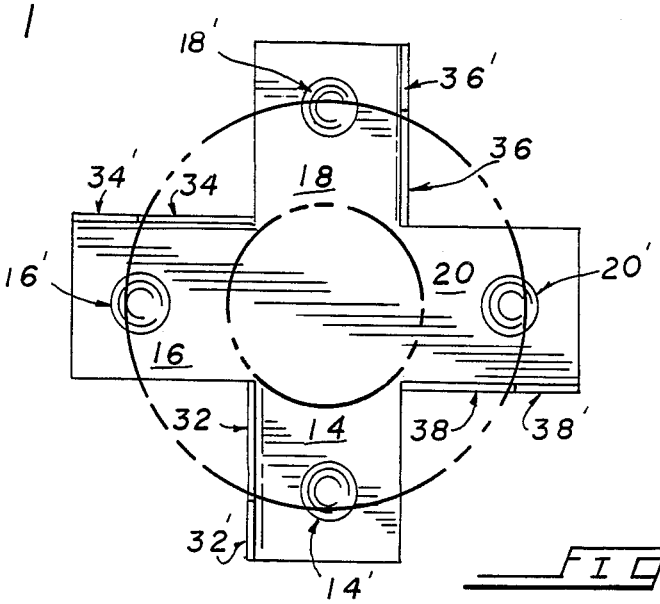
FIG. 3 is a top view thereof.
Figure 4:
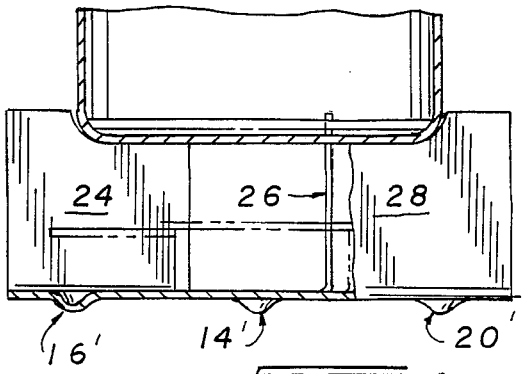
FIG. 4 is a longitudinal cross-sectional view of FIG. 1.

Referring now to the drawings in greater detail, and specifically to Figs. 1 through 4, the supporting stand for supporting pots, pans, chafing dishes and the like, is indicated generally by reference number 10 in FIG. 1. The stand 10 has especial use in the type of cooking called fondue, where a chafing dish, or fondue pot, indicated in dotted lines in FIG. 1, is supported on a stand, under which pot is supported a burner for cooking the contents of the pot, the burner being also shown in dotted lines in FIG. 1. Thus, the stand 10 is provided with a central vacated hub region 12 in which is placed the burner. The stand 10 is provided with four radially-extending, horizontal support flanges 14, 16, 18, and 20, which form a substantial X-shape, as shown in FIG. 3. Extending from the bottom surface of each flange member is a downwardly-projecting dome-shaped nipple spacing member 14', 16', 18' and 20', which actually contacts the upper surface of a table, so that the stand 10 is spaced upwardly from the table surface, to thus protect the table proper from the heat generated by the burner. These supporting domes or nipples may also be heat insulated, if so desired, and are preferably forged during the manufacturing process. Extending vertically upwardly from one longitudinal side edge surface of each supporting flange member is a vertical supporting partition or wall, indicated by reference numerals 22, 24, 26 and 28 in the drawings. Each longitudinal edge surface from which projects a respective vertical supporting wall or partition is that which faces the other flange member in the clockwise direction when viewing FIG. 1. Thus, when making one complete circle about the stand 10, every other longitudinal edge surface has a vertical partition extending upwardly therefrom. As may be clearly seen in FIG. 1, each partition thus lies offset from and parallel to the central longitudinal axis of the respective flange member of the pairs of flange members 14, 18, and 16, 20. Such an arrangement ensures that each vertical plane containing the vertical wall, or partition, is spaced from or intersects the planes containing therein the diameters of the circular pot being supported by the stand 10, for reasons to be discussed below. Thus, each plane of the respective vertical partition contains therein a chord of the circular cross section of the pot or pan being supported, in contradistinction to containing the diameter thereof.

Each of the vertical partitions is provided with an upper edge surface 32, 34, 36 and 38, each lying substantially in a horizontal plane. Each of these horizontal edge surfaces transform into another upper horizontal edge surface 32', 34', 36' and 38' via an arcuate transition zone therebetween. As is clearly shown in FIG. 1, the bottom surface portions of a pot or pan rest upon the horizontal edge surfaces 32, 34, 36, and 38, and lower circumferential surface portions thereof abut up against the arcuate transition surfaces formed between the inward portions of the horizontal edge surfaces 32', 34', 36' and 38', and the outward ends of the lower horizontal surfaces 32,34, 36, and 38 in order to snuggly and firmly support the pot, pan or chafing dish thereby, and to limit outward movement of the pot, pan or chafing dish.

The vertical partitions 22 and 26 form a first pair that are parallel to each other, but where each lies in a vertical plane spaced from the vertical plane of the other of the pair. The vertical partitions 24 and 28 form the other or second pair of partitions, also being parallel and spaced apart from each other in vertical planes. The partitions 22 and 24 are angularly closer spaced to each other than the petitions 22 and 28, or the petitions 24 and 26. Similarly, the petitions 26 and 28 are angularly closer to each other than the partitions 26 and 24 or the petitions 28 and 22. Thus, it can be seen that each of the upper edge surfaces of each vertical partition supports the bottom portion of the pot, pan or chafing dish along a chordally-extending portion thereof angularly offset from or at an angle to the diameter of the pot or pan. this offsetting adds considerable beneficial results to the prevention of the tilting over of the pot or pan from its supporting relationship with the stand 10, in contrast to the case where each of the vertical partitions were to be contained in a plane passing through one of the diameters of the circular pot, pan or chafing dish. This is explained by the fact that, upon the tilting of the stand 10 in any direction, such that the pot is caused to tend downwardly by the force of gravity, and caused to tend to pivot about a fulcrum defined at the inward surface of the upper horizontal surfaces 32', 34', 36' and 38', which fulcrum is angularly offset from or at angle to any diameter of the pot or pan, there is created tendency to cause the pot or pan to rotate in a plane containing therein the lower horizontal surfaces 32, 34, 36, and 38 which rotation is prevented from being achieved, since the other three vertical partitions prevent such rotation owing to the fact that they are not positioned along the diameter of the pot or pan. Thus, since the location of each partition is in a chordally-offset manner from the diameters of the pan or pot, the fulcrum will tend to cause pivotal movement to the pot or pan at a point offset from the diameter thereof, such that the other three vertical partitions prevent such movement, which would not occur if all four vertical partitions were positioned in vertical planes along the major diameters of a pot or pan. Thus, regardless of how the stand 10 may be tilted, the pot or pan is held firmly. The same safe and secure nature is achieved even if the pot itself were to be tilted relative to the stand itself for the same reasons given above.

The fondue stand 10 may be made of stainless steel, porcelain enameled steel, electroplated steel, brass-plated steel, chromium-plated steel, copper-plated steel or tin-plated steel.

Figure 5:
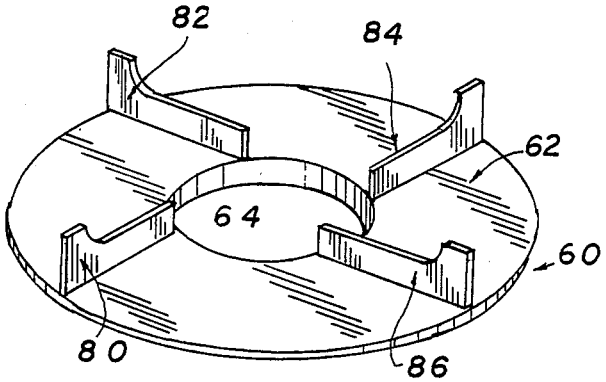
FIG. 5 is an isometric view of another embodiment of the invention showing a supporting stand in the form of a security ring for use on top of a range of a conventional stove for supporting pots or pans above the flame of the range to provide greater stability.
Figure 6:
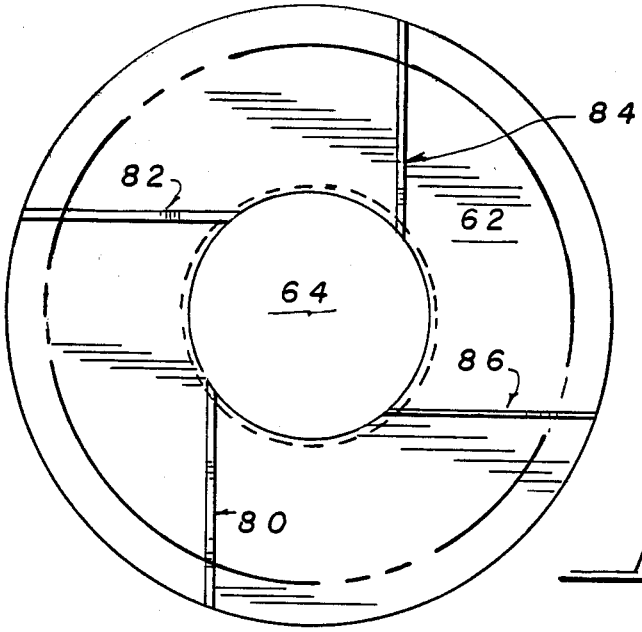
FIG. 6 is a top view thereof.
Figure 7:
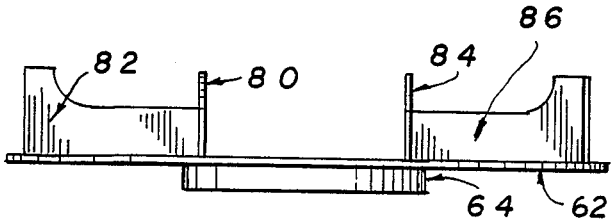
FIG. 7 is a side elevational view thereof.
Figure 8:
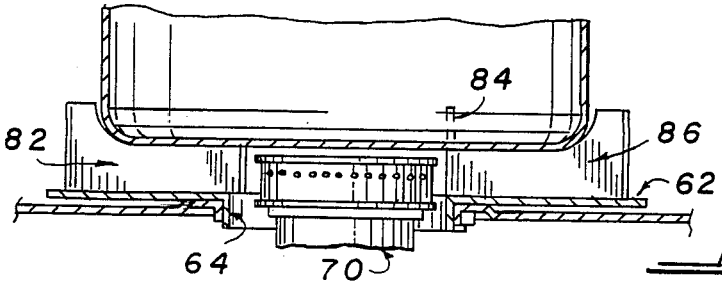
FIG. 8 is a longitudinal cross-sectional view of the stand of FIG. 5.

The same general concept as described above may be used for providing a security ring for the range of a stove, whether gas or electric. This embodiment is shown in FIG. 5, and is indicated generally by reference numberal 60. The stand 60 is circular in outline, and includes a cricularly shaped flat disc 62 having a central circular cutout, through which partially projects the gas jet apparatus of the range, as shown in FIG. 8 by reference numberal 70. A hub region 64 is defined by a cylindrical wall or tube as shown in FIG. 8, from the upper edge of which radially extends the flat disc 62 of the stand 60. The cylindrical tube 64 projects downwardly into the circular cutout formed on top of the range, through which circular cutout projects centrally thereof the gas jet apparatus of the range, to thereby firmly install the security ring 60. As clearly shown in FIGS. 5, 6 and 7, there are provided vertical partitions or walls 80, 82, 84 and 86 similar to the partitions 22, 24, 26 and 28 of the embodiment of FIGS. 1 through 4, which function in exactly the same manner. Thus, a circular pot or pan placed on the security ring 60 is given a greater degree of safety than hitherto possible, and protects against accidental spillage or tipping over of the pot or pan, as well as accidents originating from small children or the like.

While specific embodiments of the invention have been shown and described, it is to be understood that numerous changes and modifications may be made therein without departing from the scope, spirit, and intent of the invention as set forth in the appended claims.

What I claim is:

1. A stand for supporting pots, pans, chafing dishes, and the like, comprising:

a main supporting portion for resting upon a surface therebelow;

four vertically upstanding partition walls angularly spaced apart from each other, each said partition wall defining an upper horizontal flat edge surface and a transition surface at the outward end of the respective said flat edge surface and projecting upwardly therefrom to define the surface against which an outer circumferential surface portion of a pot or pan abuts during the supporting thereof;

each of said partition walls lying in a vertical plane different from the vertical plane of each other said partition wall; two of said partition walls lying in parallel vertical planes to define a first pair of said partition walls, the other two of said partition walls lying in vertical planes parallel to each other to define a second pair of said partition walls; said vertical planes of said first pair extending at an angle with respect to said vertical planes of said second pair.

2. The stand according to claim 1 wherein said main supporting portion comprises a vacated central region about which are angularly spaced said four vertical partition walls, said central region providing a region in which is placed a burner for a fondue set.

3. The stand according to claim 2, in combination with a fondue burner, and fondue pot, said burner being supported on said vacated central region, said fondue pot being positioned thereabove.

4. The stand according to claim 3, wherein said fondue pot is circular in cross section; each said vertical plane of each said partition wall containing therein a chord of said circular cross section of said fondue pot, said chord being defined as not part of any diameter of said circular cross section.

5. The stand according to claim 1, wherein said first pair of partition walls has one partition wall thereof angularly spaced closer to one of the partition walls of the second pair of partition walls as compared to the other partition wall of said second pair, to thereby define the offset relationship of the partition walls with respect to the planes containing the diameters of the pot or pan resting thereon.

6. The stand according to claim 1, wherein each said partition wall further comprises another upper horizontal edge surface being at a higher elevation with respect to said flat edge surface, said transition surface of each said partition wall connecting said flat edge surface to said another horizontal edge surface.

7. The stand according to claim 6, wherein said transition surface is substantially arcuate in shape.

8. The stand according to claim 1, wherein said main supporting portion comprises a lower horizontal surface, and a plurality of downwardly-projecting supporting spacer members for contact against the surface upon which said stand is to be supported, to thereby protect the surface from the heat generated by the cooking process.

9. The stand according to claim 1, wherein said main supporting portion is substantially shaped, and comprises four flange members, each said flange member defining a first longitudinal edge surface from which upwardly projects a respective one of said four vertical partition walls; each said flange member further comprising a second longitudinal edge surface parallel to said first longitudinal edge surface, each said second longitudinal edge surface having an inward end connected to the inward end of said first longitudinal edge surface of another adjacent respective said flange member.

10. The stand according to claim 1, wherein said main supporting portion is circular in shape and comprises a central circular cutout region, and a central hollow hub projecting downwardly from said main portion and in alignment with said central circular cutout region, said central hollow hub being positional in the circular opening of a range of a stove.

11. The stand according to claim 10, in combination with a stove, said stove having at least one range thereon, said hub being positioned in said range, said range having an upwardly projecting gas jet burner partially extending into the hollow interior of said central hub.

12. The stand according to claim 10, wherein each of said four vertical partition walls has a first inward end positioned directly adjacent to the circumference of said central circular cutout of said main body portion.

13. The stand according to claim 1, wherein said vertical planes of said first pair are perpendicular to said vertical planes of said second pair.

* * * * *